US005899597A

United States Patent [19]

Shinohara et al.

[11] Patent Number: 5,899,597

[45] Date of Patent: May 4, 1999

[54] TONER CARTRIDGE WITH AN EXTERNAL REFLECTOR FOR A DEVELOPER APPARATUS CAPABLE OF OPTICALLY END-DETECTING

[75] Inventors: Tadashi Shinohara, Tokyo; Kouichi Noguchi, Machida; Eiichi Sasaki, Sagamihara; Kouichi Irie, Gotenba, all of Japan

[73] Assignee: Ricoh Company Ltd., Japan

[21] Appl. No.: 08/734,610

[22] Filed: Oct. 18, 1996

Related U.S. Application Data

[63] Continuation-in-part of application No. 08/361,950, Dec. 22, 1994, Pat. No. 5,621,221.

[30] Foreign Application Priority Data

Dec. 22, 1993 [JP] Japan ..... 5-324036
Feb. 15, 1994 [JP] Japan ..... 6-018205

[51] Int. Cl.[6] ..... G03G 15/10

[52] U.S. Cl. ..... 399/64; 399/62

[58] Field of Search ..... 399/27, 30, 58, 399/61, 62, 64, 65, 110, 119, 252, 258, 262; 250/221, 222.1, 573, 575, 576, 577

[56] References Cited

U.S. PATENT DOCUMENTS

| | | | |
|---|---|---|---|
| 3,765,654 | 10/1973 | Rarey et al. | 399/64 |
| 3,872,824 | 3/1975 | Erny et al. | 399/65 |
| 4,155,652 | 5/1979 | Buchan et al. | 399/64 |
| 4,579,253 | 4/1986 | Shenier | 222/56 |
| 4,646,679 | 3/1987 | Ohno et al. . | |
| 4,673,820 | 6/1987 | Kamen | 250/573 |
| 4,750,015 | 6/1988 | Ogura et al. . | |
| 4,782,360 | 11/1988 | Iwamoto et al. . | |
| 4,792,825 | 12/1988 | Saito et al. . | |
| 5,035,198 | 7/1991 | Niito . | |
| 5,182,600 | 1/1993 | Hasegawa et al. . | |
| 5,258,819 | 11/1993 | Kimura et al. . | |
| 5,276,481 | 1/1994 | Kinoshita et al. | 399/64 X |
| 5,532,790 | 7/1996 | Akazawa | 399/64 |

FOREIGN PATENT DOCUMENTS

| | | |
|---|---|---|
| 61-151576 | 7/1986 | Japan . |
| 61-180266 | 8/1986 | Japan . |
| 63-2087 | 1/1988 | Japan . |
| 63-78169 | 4/1988 | Japan . |
| 2-114281 | 4/1990 | Japan . |
| 4-361278 | 12/1992 | Japan . |
| 5-297711 | 11/1993 | Japan . |

*Primary Examiner*—Sandra Brase
*Attorney, Agent, or Firm*—Knoble & Yoshida LLC

[57] ABSTRACT

A method and a system for optically detecting an empty condition in a toner cartridge has a light reflector placed on an outside surface of a toner cartridge wall. A light source emits light directly or ultimately towards the light reflector and the reflected light is detected by a light detection device if the toner cartridge is sufficiently empty.

15 Claims, 12 Drawing Sheets

TONER CARTRIDGE WITH AN EXTERNAL REFLECTOR FOR A DEVELOPER APPARATUS CAPABLE OF OPTICALLY END-DETECTING

CROSS-REFERENCE TO RELATED APPLICATIONS

This application is a continuation-in-part of application Ser. No. 08/361,950 filed Dec. 22, 1994, now U.S. Pat. No. 5,621,221.

BACKGROUND OF THE INVENTION

1. Field of the Invention

This invention relates to a developer apparatus that is applicable to image-forming equipment such as copiers, facsimile machines, and printers. In particular, it relates to a developer apparatus equipped with a developer that renders electrostatic images formed on an image carrier into visible images, a toner storage unit that contains the toner to be supplied to the developer, and a toner residual amount detection means having a light-emitting unit and a light sensor and that detects the amount of residual toner in the aforementioned toner storage unit.

Among the known toner residual amount detection means that are employed in this type of developer apparatus is one that contains, at a minimum, the end of a light transmission component that follows a light source that comprises a part of said detection means and the end of a light transmission component that follows a light sensor device, such that these ends are provided along the interior wall of the toner storage unit within the toner storage unit in which toner can be contained. (Refer to the OFFICIAL GAZETTE FOR UNEXAMINED JAPANESE PATENT APPLICATIONS H2-17112 (1990).)

If the light transmission component of said detection means, as in the aforementioned constitution, is provided along the interior wall of the toner storage unit, the light path must be bent within the toner storage unit in order to ensure that the light emitted by the light-emitting unit reaches the light sensor. To bend the light path, optical fibers and other expensive materials are used as light transmission components. This increases the manufacturing costs of the toner residual amount detection means, which results in an overall increase in the manufacturing costs for the developer apparatus as a whole.

The present invention has been developed in view of the issues identified above. The purpose of the present invention is to provide a developer apparatus equipped with a toner residual amount detection means that is capable of determining whether toner remains in the developer.

2. Brief Summary of the Invention

To accomplish the above objective, one aspect of the invention is characterized as follows: In the developer apparatus equipped with a developer that renders electrostatic images formed on an image carrier into visible images, a toner storage unit that contains the toner to be supplied to said developer, and a toner residual amount detection means having a light-emitting unit and a light sensor and that detects the amount of residual toner in the aforementioned toner storage unit; a developer apparatus comprising: forming a hollow recess facing the light-emitting unit and a recess facing the light sensor by causing the walls of the aforementioned toner storage unit, located opposite the aforementioned light-emitting unit and the light sensor, to protrude into the inside of the aforementioned toner storage unit; forming transparent units on the opposite walls of said pair of hollow recesses relative to the light received from the light-emitting unit; forming a reflector, on an outer surface of the aforementioned recess opposite the light-emitting unit, that reflects the light from said light-emitting unit to the aforementioned transparent unit on said recess located opposite the light-emitting unit; and forming a reflector, on the aforementioned recess opposite the light sensor, that reflects the light that has passed through the aforementioned transparent unit on the aforementioned recess opposite the light-emitting unit, to the aforementioned light sensor.

According to other aspects of the current invention, the light emitted from the light-emitting unit enters the recess opposite the light-emitting unit. This light is reflected by the reflector located on the recess opposite the light-emitting unit and passes through the transparent unit located on the recess opposite the light-emitting unit. Moreover, the light that has passed through the transparent unit passes through the area in the toner storage unit in which toner can exist. If no toner is present in the toner storage unit, the light passing through this area directly passes through the transparent unit located on the recess opposite the light sensor, and the light is reflected by the reflector located on the recess opposite the light sensor and is detected by the light sensor. On the other hand, if toner still exists in the toner storage unit, and between the transparent units formed on the walls located on the pair of hollow recesses, the light reflected by the reflector on the recess opposite the light sensor passes through the transparent unit on the recess opposite the light-emitting unit. After that, the light is blocked by the toner and is consequently prevented from being sensed by the light sensor. Thus, the light emitted by the light-emitting unit is bent by using a reflector that is provided on the opposite recesses. The light beam is thus made to pass through the area in which toner could exist and is guided to the light sensor. In this manner, whether toner still exists in the toner storage unit is determined on the basis of whether light is sensed by the light sensor.

According to another aspect of the invention, the light beam emitted by the light-emitting unit is directed by the reflectors that are provided on an outer surface of the recess opposite the light-emitting unit and on the recess opposite the light sensor. The light beam is made to pass through the area in which toner could exist, and to reach the aforementioned light sensor. In order to determine whether some toner is remaining in the toner storage unit on the basis of whether the light sensor has sensed the light beam, the wall parts of the toner storage unit that protrude to the light-emitting unit and the light sensor are made to protrude to the interior of the aforementioned toner storage unit, thus forming a hollow recess opposite the light-emitting unit and a hollow recess opposite the light sensor. Therefore, an expensive material, such as an optical fiber, does not need to be used in the part corresponding to the aforementioned pair of recesses. Therefore, the present invention offers the advantage of allowing the production of low-cost equipment.

DETAILED DESCRIPTION OF THE INVENTION

The following describes a mode of embodiment of the present invention as applied to a color printer (hereinafter the "printer"), which is an image-forming apparatus.

Figure 1:
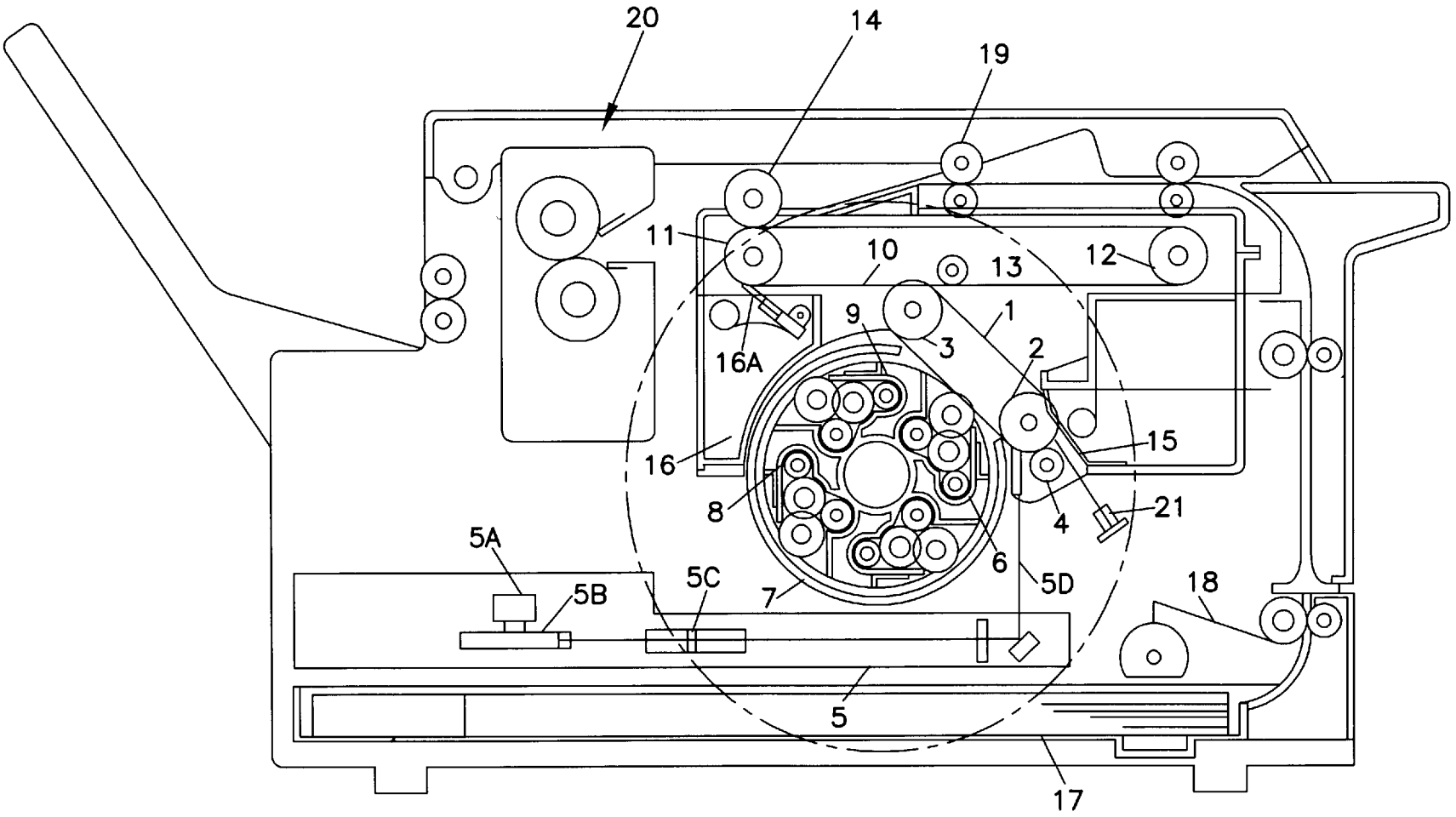
FIG. 1 diagramatically illustrates a frontal view that shows an overall constitution of the printer of an embodiment according to the invention.

FIG. 1 is a schematic diagram of a printer that incorporates the developer apparatus of the present embodiment mode. In FIG. 1, item 1 denotes a flexible light-sensitive belt that serves as a belt-shaped image carrier. The light-sensitive belt 1 is installed between the rotary rollers 2 and 3 and is moved clockwise by the rotation of rotary rollers 2 and 3. 4 denotes an electrostatic charging component as an electrostatic charging means. 5 denotes a laser write unit as an exposure means. 6–9 denote developer units that store developing agents of specific colors. A laser write unit 5 is stored in a holding case, with a slit-shaped exposure opening provided on the top, and is incorporated into the system unit.

The aforementioned laser write unit 5 also incorporates an optical system with integrated light-emitting and converging light transmission units in addition to the components that are shown in the figure. The aforementioned electrostatic charging component 4, a laser write unit 5D, and a photosensitive cleaning apparatus 15 are provided in a roller 2 of multiple rollers on which the photosensitive belt 1 is mounted.

The aforementioned developer units 6–9 hold various developing agents, such as yellow, magenta, cyan, and black. These units are equipped with developer sleeves that approach or come into contact with the light-sensitive belt 1 at a fixed position. They perform the function of rendering the latent image on the light-sensitive belt 1 into an actual image by means of either the non-contact development method or the contact development method. 10 denotes an intermediate transfer belt as a transfer image carrier. The intermediate transfer belt 10 is mounted between the rotary rollers 11, 12 and is moved counterclockwise by the action of the rotary rollers. Furthermore, light-sensitive belt 1 and intermediate transfer belt 10 touch each other within the rotary roller 3 so that the first image on light-sensitive belt 1 is transferred to an intermediate transfer belt 10 by means of a bias roller 13 that is provided within the intermediate transfer belt 10. By repeating similar processes, the second, third, and fourth actual images are transferred onto the intermediate transfer belt 10 in such a way that they are superimposed without any positional misalignment. Also, a transfer roller 14 is provided in such a way that it can touch the intermediate transfer belt 10. 15 denotes a cleaning device for the light-sensitive belt 1, and 16 denotes a cleaning device for the intermediate transfer belt 10. During image formation, a blade 16A is held at a position off the surface of the intermediate transfer belt 10. The blade is pressed onto the surface of intermediate transfer belt 10, as shown in the figure, only during the cleaning operation which is performed after an image has been transferred.

The process of color image formation takes place as follows in the printer as described above: First, multi-color images in the present mode of embodiment are formed by means of the following image formation system: Specifically, an original image is formed as image data by computing in the image data processor the data that is obtained in the color image data input unit (not shown in the figure), which is scanned by an image pickup device. The image data is then temporarily stored in image memory. Subsequently, the image memory is fetched during recording and is input into the printer, which is a recording unit. Specifically, when color signals that are output from an image reader, which is separate from the printer, are input into the aforementioned laser write unit 5, in laser write unit 5 the laser beam generated by a semiconductor laser (not shown in the figure) is rotated and scanned by a polygon mirror 5B that is rotated by a drive motor 5A. The light path of the laser beam is bent by the mirror through an fé lens 5C. The laser beam is then directed onto the circumferential surface of the light-sensitive belt 1, which has been charge-sanitized by a charge-sanitizing lamp 21 and which has been uniformly charged by an electrostatic charging component 4. This forms an electrostatic latent image. The image pattern that is exposed in this manner is a monochrome image pattern that would be obtained when a given full color image has been decomposed into yellow, magenta, cyan, and black colors. The individual electrostatic latent images thus formed are developed by a rotary developer that is equipped with yellow, magenta, cyan, and black developing units. The latent image is rendered into actual images and monochrome images are formed as a result. The monochrome images formed on light-sensitive belt 1 are transferred onto a counterclockwise rotating intermediate transfer belt 10 while touching the light-sensitive belt 1. The yellow, magenta, cyan, and black monochrome images that have been formed on the light-sensitive belt I are sequentially superimposed onto the surface of the intermediate light-sensitive belt 10. After that, the yellow, magenta, cyan, and black images that have been superimposed onto the surface of intermediate light-sensitive belt 10 are transferred by a transfer roller 14 onto the transfer paper which has been transported to the transfer unit from paper tray 17 through a paper feed roller 18 and a resist roller 19. Following the transfer process, the transfer paper is fixed by a fixing device 20, and this completes the full color image formation process. It should be noted that both the intermediate transfer belt 10 and the light-sensitive belt 1 are seamless belts.

Figure 2:
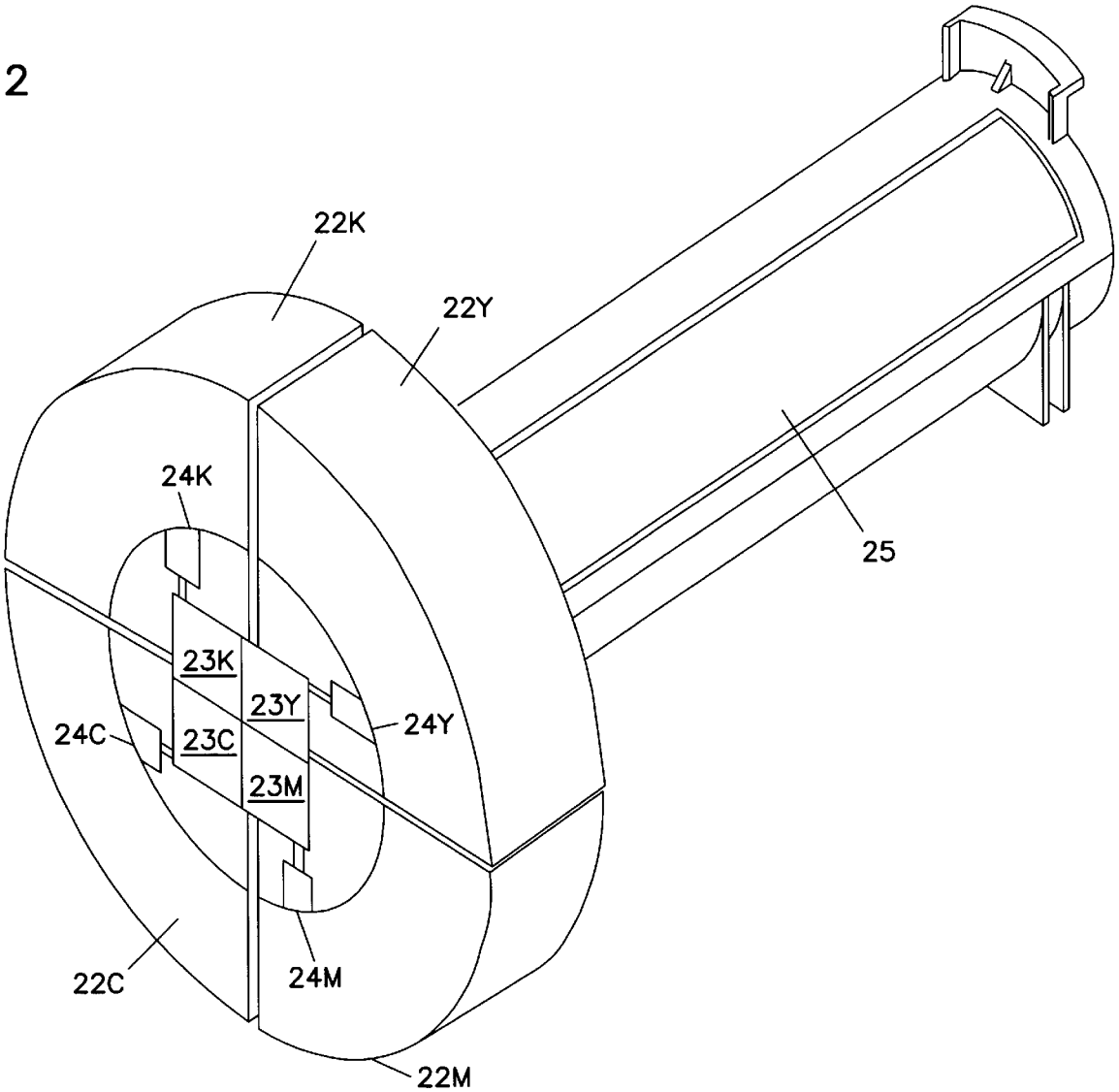
FIG. 2 diagramatically illustrates a perspective view that shows an overall constitution of the developer apparatus of an embodiment according to the invention.

FIG. 2 is a perspective diagram of the developer apparatus of the present invention. Codes 22Y, 22M, 22C, and 22K denote toner cartridges that hold, respectively, yellow, magenta, cyan, and black toners. Similarly codes 23Y, 23M, 23C, and 23K denote toner hoppers that hold, respectively, the yellow, magenta, cyan, and black toners that have been supplied by the respective toner cartridges. During development, the toner cartridges and hoppers of various colors and the aforementioned developer units rotate in an integral manner. They stop at the position of opening 26 and develop the latent image that has been formed on the light-sensitive belt 1.

Figure 3:
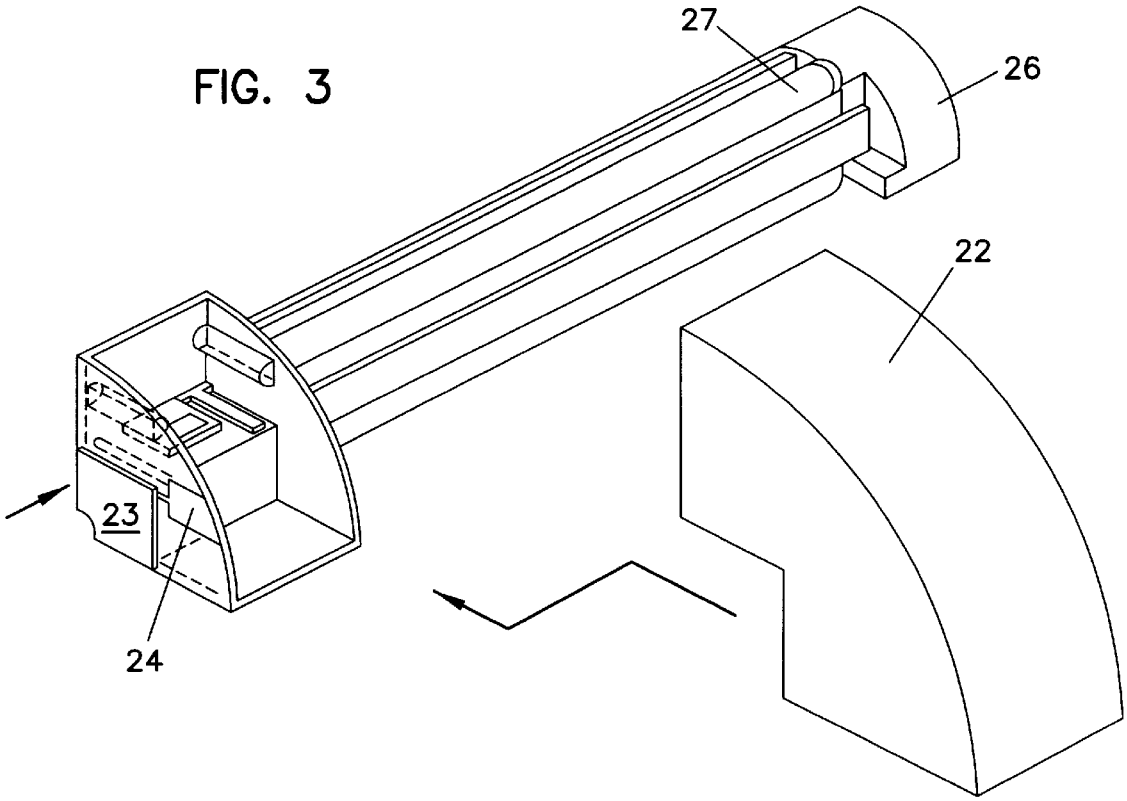
FIG. 3 diagramatically illustrates a developer unit with the toner cartridge removed.

Furthermore, as shown in FIG. 3, the aforementioned toner cartridges 22 and the developer units 26 are designed so that they can be replaced as the toners are consumed or expire. In particular, the cartridge 22 can be mounted and detached simply by operating the mounting lever 24. This allows the user to replace the cartridge 22 easily. In the figure, code 27 denotes the developer roller.

Figure 4:
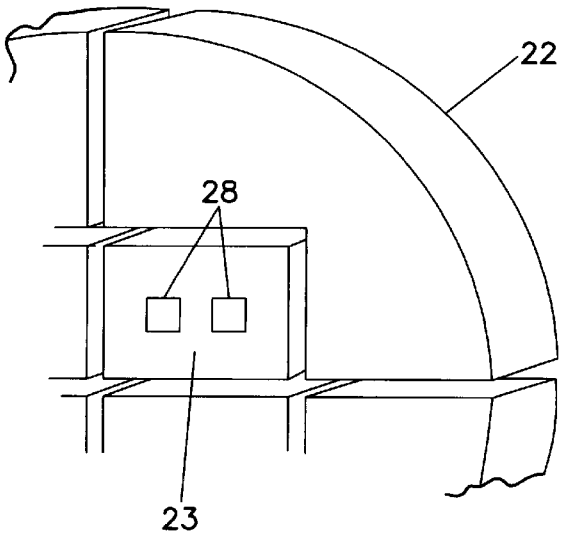
FIG. 4 diagramatically illustrates the end-of-toner detection unit that is provided on the wall part of the toner hopper.
Figure 5:
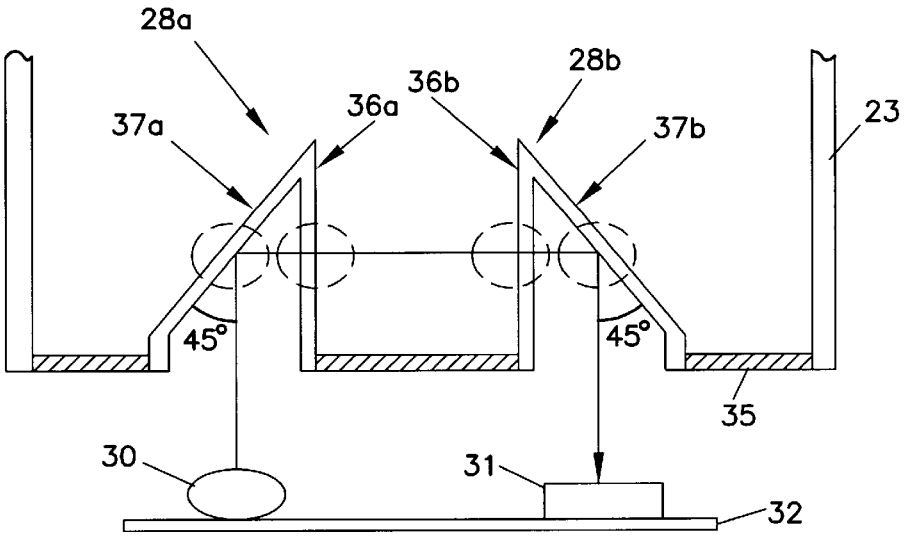
FIG. 5 diagramatically illustrates one embodiment of an end-of-toner detection unit according to the current invention.

FIGS. 4 and 5 show an overall configuration of the end-of-toner detection means of the present invention. This end-of-toner detection means has an end-of-toner detection unit 28 which is configured as follows: a hollow recess opposite the light-emitting unit 28*a* and a recess opposite the light sensor 28*b* that are formed on the end-of-toner detection unit by causing the walls 35 of the toner hopper 23 that are opposite the light-emitting unit (infrared LED) 30 and the light sensor (remote controller light sensor device) (31) that are mounted on the same substrate 32 to protrude into the interior of the toner hopper 23. The end-of-toner detection means also has transparent units 36*a* and 36*b*, which are transparent to the light emitted by the light-emitting unit 30, on one or both of the walls on the pair of opposite hollow recesses. On the recess opposite the light-emitting unit 28*a*, a reflector 37*a* is formed that reflects the light beam coming from the light-emitting unit 30 toward the transparent unit 36*a* that is located on the recess opposite the light-emitting unit 28*a*. Also, on the recess opposite the light sensor 28*b*, a reflector 37*b* is formed that reflects the light beam that has passed through the transparent unit 36*b* located on the recess opposite the light sensor 28*b* toward the light sensor 31.

In this embodiment mode, the aforementioned recesses 28*a* and 28*b* are made of a transparent material such as polycarbonate (hereinafter "PC"). However, it suffices to use a transparent material only on the sidewalls, at a minimum, of the aforementioned pair of mutually opposing hollow recesses, i.e., only on the aforementioned transparent units 36*a* and 36*b*. Also, although in the example of FIG. 4, recesses 28*a* and 28*b* are provided on the near-side wall 35 of the toner hopper 23 in the figure, the walls may also be positioned on the far-side.

In this embodiment mode, the end-of-toner condition is detected as follows: In FIG. 5, the light beam emitted by the light-emitting unit 30 is reflected by the reflector 37*a* of the aforementioned recess opposite the light-emitting unit 28*a* that is formed on the wall 35 located opposite the light-emitting unit 30. This light beam then passes through the transparent unit 36*a*. If the amount of toner remaining in the toner hopper 23 is greater than a specified amount, the light that has passed through the transparent unit 36*a* is blocked by the toner and does not enter the transparent unit 36*b* of the aforementioned recess opposite the light sensor 28*b*, and consequently does not reach the light sensor 31. On the other hand, if the amount of toner remaining is less than a specified amount, the light that has passed through the transparent unit 36*a* is not blocked by the toner and therefore enters the transparent unit 36*b* of the aforementioned recess opposite the light sensor 28*b*. Subsequently, this light is reflected by the reflector 37*b* and is sensed by the light sensor 31. Thus, the light beam emitted by the light-emitting unit 30 is sensed by the light sensor 31 only when the amount of toner remaining is less than a specified value. In this manner, the end-of-toner condition can be detected by determining whether light is sensed by the light sensor 31.

In this embodiment mode, the aforementioned recess opposite the light-emitting unit 28*a* is constituted in such a way that the light reflected by the reflector 37*a* enters the transparent unit 36*a* from a vertical angle; likewise, the aforementioned recess opposite the light sensor 28*b* is constituted in such a way that the light that has passed through the transparent unit 36*a* located in the recess opposite the light-emitting unit 28*a* enters the transparent unit 36*b* of the recess opposite the light sensor 28*b* from a vertical angle. In the above example of FIG. 5, the incident angle at which the light emitted by the light-emitting unit 30 falls incident upon the reflector 37*a* of the recess opposite the light-emitting unit 28*a*, and the angle of reflection of light at which the light is reflected by the reflector 37*b* of the recess opposite the light sensor 28*b* to the light sensor 31 are both set at 45 degrees. This ensures that the transmittance of the light emitted by the light-emitting unit 30 as it passes through the transparent units 36*a* and 36*b* is greater than the transmittance that would result if the light entered the transparent units 36*a* and 36*b* from an angle other than a vertical angle. In this manner, the light beam is guided to the light sensor 31 with little diminution in the quantity of light, thus increasing the quantity of light sensed by the light sensor 31. This enhances the accuracy of end-of-toner detection.

Although not shown in FIG. 5, the parts of the reflectors 37*a* and 37*b* in the aforementioned recesses 28*a* and 28*b* are made with components that have a higher light reflectivity than other components. For example, pieces of silver-colored reflecting tape are affixed onto those parts. In this manner, light is reflected with a higher reflectivity when compared with cases in which no reflecting tape is attached, and thus the quantity of light sensed by the light sensor 31 is increased.

It should be noted that it is easier to affix reflecting tape onto the exterior walls of a recess, i.e., on the surfaces that are in contact with the toner, than onto the interior walls of the recess. Because affixing the tape on the exterior walls enhances the operational efficiency during the manufacturing process, by affixing the reflecting tape as illustrated in the present embodiment mode it is possible to reduce manufacturing costs.

The functional requirement for the aforementioned reflectors 37*a* and 37*b* is the capacity to reflect light at high reflectivity. Therefore, the construction of the reflectors is not limited to the use of a reflecting tape: the reflectors 37*a* and 37*b* can be made with components that have a higher reflectivity than other components or gold can be vapor-deposited on the reflectors 37*a* and 37*b*. However, simply affixing a reflecting tape, as indicated above, results in lower manufacturing costs.

Figure 6:
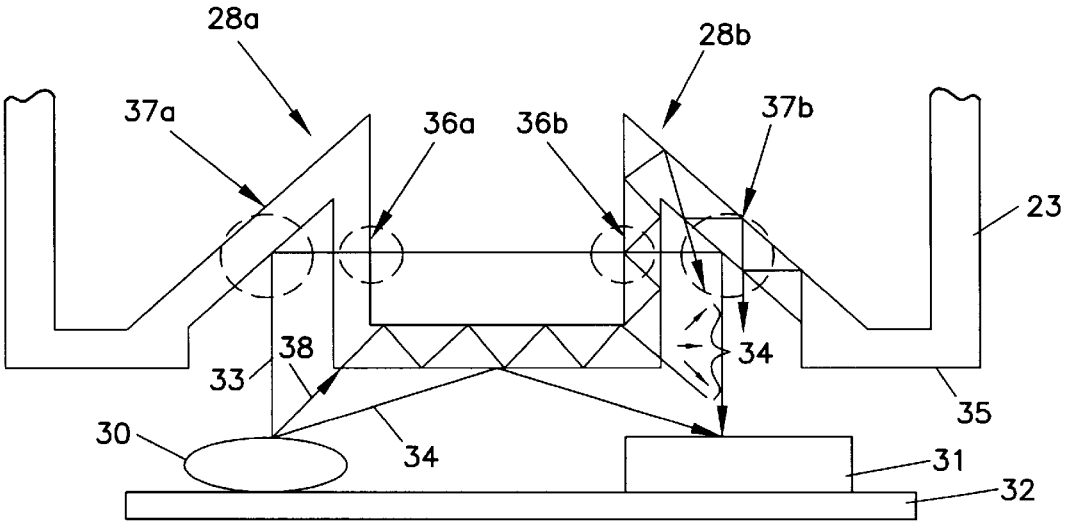
FIG. 6 diagramatically illustrates an effect of diffused light source on the end-of-toner detection unit.

If a light source with a wide directional angle is employed as the light source for the light sensor 30, in addition to the light 33 that is supposed to be sensed by the light sensor 31, propagation light 38 is liable to be generated that falls incident upon the wall 35 of the toner hopper 23 opposite the light-emitting unit 30 and the light sensor 31, as shown in FIG. 6. This light passes through the thick part of the wall and ultimately is sensed by the light sensor 31. Because this light is also detected by the light sensor 31, propagation light 38 occurs as a noise in the detection output. This could cause a detection error in which the system erroneously senses that there is no toner remaining even if toner is still present.

To address this problem, the wall 35 of the toner hopper 23, specifically the thick part of the wall 35, is made of material that is opaque to light, such as black PC. This eliminates the aforementioned propagation light 38 among the light beams that are extraneous to the detection of the end-of-toner condition so that this light beam is not sensed by the light sensor 31. In this manner the occurrence of an erroneous end-of-toner detection is prevented in which the light extraneous to the detection of the end-of-toner condition is detected by the light sensor 31.

Because the aforementioned black PC also exhibits a light absorption property, contrary to the situation illustrated in FIG. 6, the wall 35 does not produce reflected light 34, it is possible in the present embodiment mode also to prevent the occurrence of an erroneous end-of-toner detection in which the reflected light 34 is detected by the light sensor 31.

Although the aforementioned thick part is made of black PC as a material opaque to light, the present invention is not limited to this material.

Figure 7:
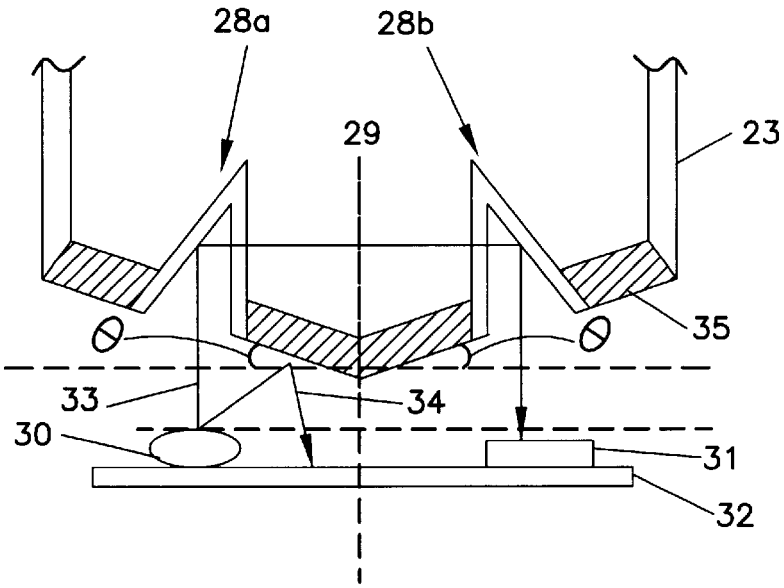
FIG. 7 diagramatically illustrates the angle between the side parallel to the substrate surface having a light-emitting unit and a light sensor and the wall of the toner hopper is such that it causes the reflected light to be reflected in a direction that prevents the light from being detected by the light sensor.

Additionally, the wall parts of the aforementioned toner hopper 23, opposite the light-emitting unit 30 and light sensor 31, respectively, can be constituted as follows: even when a part of the light emitted by the light-emitting unit 30 is reflected by a wall part 35 other than the recess opposite the light-emitting unit 28*a* or the recess opposite the light sensor 28*b* among the aforementioned wall parts, the reflected light 34 will be reflected in a direction that prevents the light from being sensed by the light sensor 31. Specifically, as shown in FIG. 7, the aforementioned wall part 35 may be constituted as follows: the recess opposite the light-emitting unit 28*a* and the recess opposite the light sensor 28*b* are set so that they are symmetrical with respect to the center line indicated by code 29; the wall part of the aforementioned toner hopper 23 is constituted so that angle q between the side parallel to the substrate surface of the aforementioned substrate 32 and the wall part 35 is such that it causes the reflected light 34 to be reflected in an direction that prevents the light from being sensed by light sensor 3 1; the result is that the reflected light 34 reflected by the wall part 35 is not sensed by the light sensor 31. In this manner the occurrence of erroneous detection of the end-of-toner condition can be prevented, in which the reflected light 34 is sensed by the light sensor 31. It should be noted that although in the present embodiment mode the angle q is set at 20 degrees, this angle is subject to change due to equipment layout limitations and the emission intensity of the light-emitting unit 30. Therefore, the angle should be set appropriately for each piece of equipment.

Figure 8:
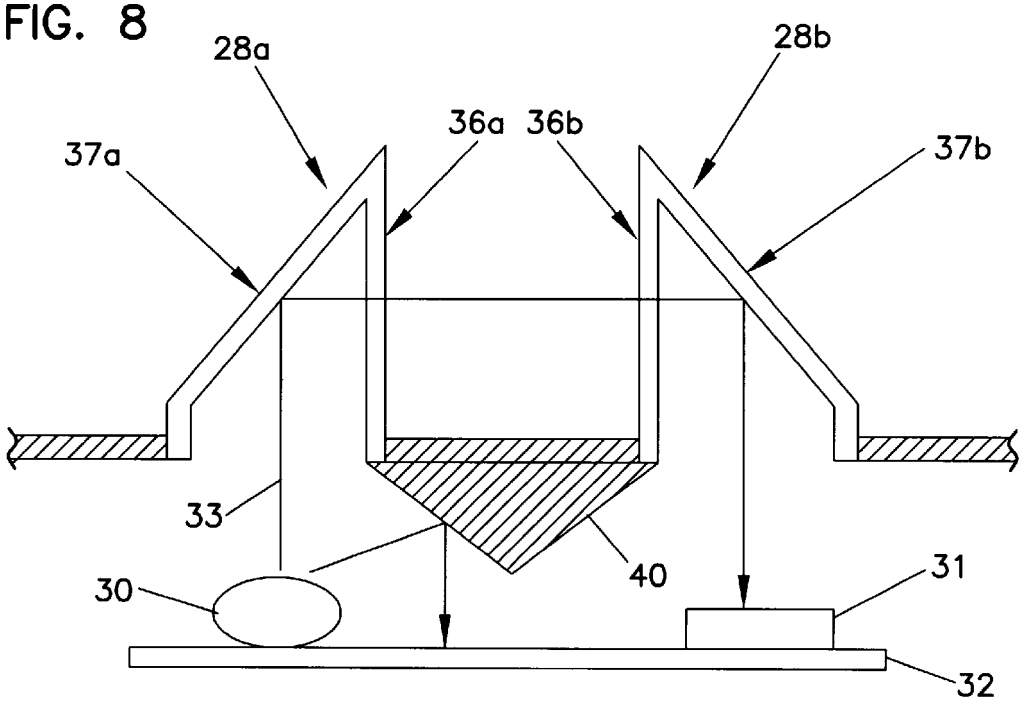
FIG. 8 diagramatically illustrates an embodiment with walls which change the direction of the reflected light beams so that the light reflected by the wall will not be detected by the light sensor.

Furthermore, as shown in FIG. 8, a component 40 may be provided between the recess opposite the light-emitting unit 28*a* and the recess opposite the light sensor 28*b* on the aforementioned wall part 35 in order to change the direction of reflection of the reflected light 34 so that the reflected light 34 reflected by the wall part 35 will not reach the light sensor 31. This component 40 may be separate from the wall part 35 of the toner hopper 23. However, to reduce manufacturing costs the component should be formed integrally with the toner hopper.

Figure 9:
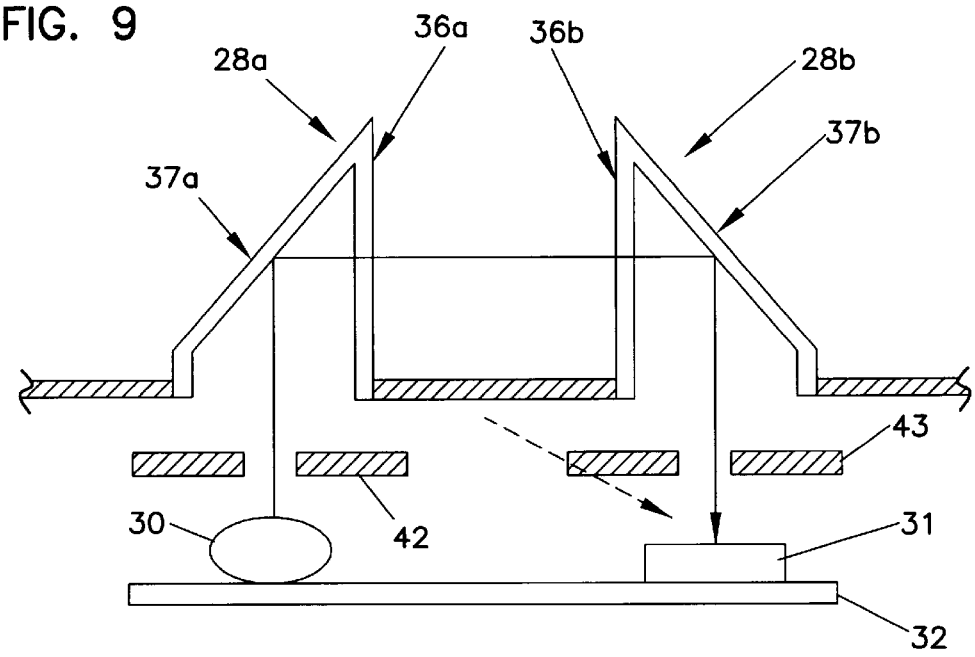
FIG. 9 is a diagram that shows apertures that are provided between the light-emitting unit and the wall, and between the light sensor and the wall, respectively, in order to limit the extent to which the light beam spreads.

Also, as shown in FIG. 9, apertures 42 and 43 may be provided between the light-emitting unit 30 and the aforementioned wall part 35 and between the light sensor 31 and the aforementioned wall part 35 in order to limit the spreading of light. According to this scheme, the aperture 42 that is provided on the light-emitting unit 30 side limits the spreading of the light beam that is directed from the light-emitting unit 30 toward the recess opposite the light-emitting unit 28*a*, so that any light reflected by the wall part 35, other than the wall part located on the recess opposite the light-emitting unit 28*a* on the aforementioned wall part 35 is blocked. Likewise, the aperture 43 that is provided on the light sensor 31 side can block any light beam other than the light beam that has passed through the recess opposite the light-emitting unit 28*a* and the recess opposite the light sensor 28*b*, e.g., the reflected light bounced by the aforementioned wall part 35, before the light beam is sensed by the light sensor 31. It should be noted that providing apertures 42 and 43 on either the light-emitting unit 31 or the light sensor 31 limits the extent of the aforementioned reflected light 34 that is sensed by light sensor 31. By providing apertures on both the light-emitting unit and the light sensor, on the other hand, it is possible to more securely block the aforementioned reflected light 34 and other light beams.

Figure 10:
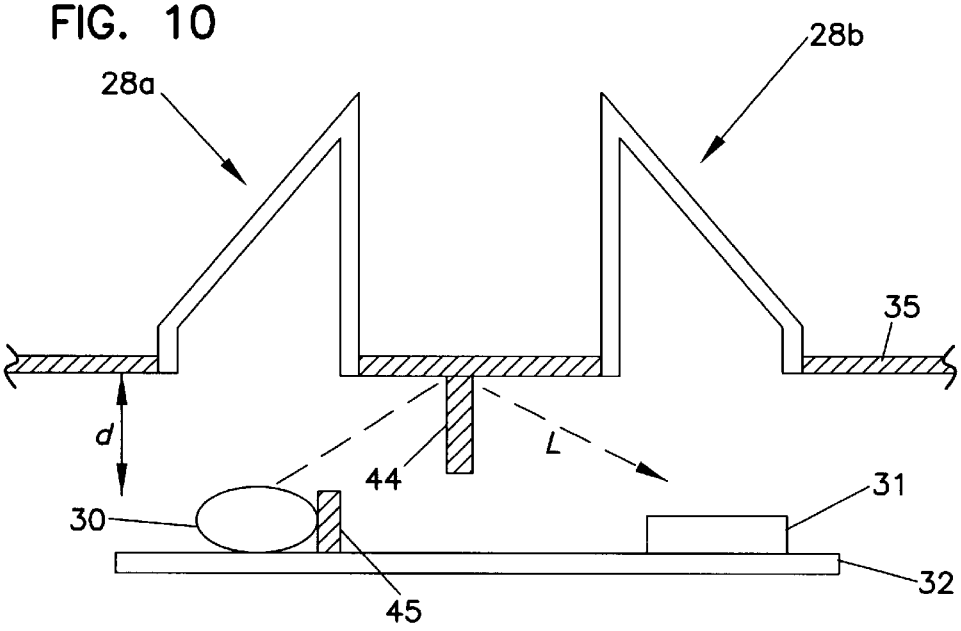
FIG. 10 is a diagram that shows an example in which a partition plate is provided on the wall of the toner cartridge as a light-shielding component that separates the light-emitting unit from the light sensor.

Furthermore, a partition plate 44 may be provided on the wall part 35 of the aforementioned toner hopper 23 as the light-shielding unit that separates the light-emitting unit 30 from the light sensor 31. This is shown in FIG. 10. In the developer apparatus of the present embodiment mode, however, the toner hopper 23 to which the partition plate 44 is attached rotates together with the developer unit. Therefore, the length L of the partition plate 44 is made shorter than the distance, d, from the aforementioned wall part 35 to either the light-emitting unit 30 or the light sensor 31, so that the partition plate does not touch either the light-emitting unit 30 or the light sensor 31. Moreover, a light-shielding component 45 as a light-shielding unit, separate from the aforementioned partition plate 44, is provided in the vicinity of the light-emitting unit 30 on the aforementioned substrate 32. This ensures that the light generated by the light-emitting unit 30 and reflected by the aforementioned wall part 35 is blocked by the aforementioned partition plate 44. Therefore, the light beam that would otherwise directly reach the light sensor 31 is blocked by the aforementioned light-shielding component 45. This reduces the amount of light, extraneous to detection purposes, that is sensed by the light sensor 31, and thus can more securely prevent the occurrence of misdetection in which the end-of-toner condition is erroneously detected.

The aforementioned partition plate 44 may also be constituted as separate from the aforementioned wall part 35. However, by constituting the partition plate in an integral manner with the wall part 35, it is possible to reduce manufacturing costs.

Figure 11:
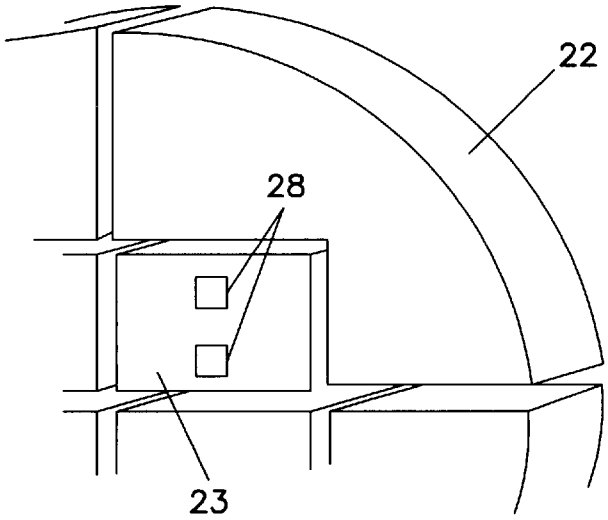
FIG. 11 is a diagram that shows an example of the layout of the recess opposite the light-emitting unit and the recess opposite the light sensor in such a way that a greater amount of toner tends to remain in the transparent unit.
Figure 12:
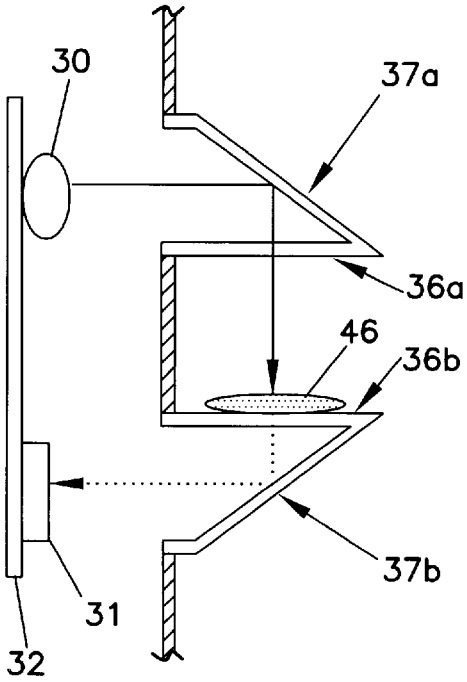
FIG. 12 is a diagram that shows the condition in which toner remains on the transparent unit that is located on the down side in the direction of gravity

The aforementioned process for detecting an end-of-toner condition is carried out by rotating the developer unit until a prescribed developing position at which development is performed and the process is carried out on the developing unit which is developing an image while the developing unit is halted at the prescribed developing position. Therefore, if the transparent units 36*a* and 36*b* of the aforementioned recesses 28*a* and 28*b* are aligned vertically when the developing unit is stopped at the prescribed developing position, as shown in FIG. 11, the development process consumes the toner inside the toner hopper 23. When the end-of-toner condition occurs, sometimes the toner remains in the transparent unit 36*b*, which is positioned on the lower side in the direction of gravity, as shown in FIG. 12. If toner remains in the transparent unit in this manner, the system determines that there still is some toner left even when there is no toner remaining in the toner hopper 23. This leads to an erroneous detection of an end-of-toner condition. Therefore, it is necessary to position the sides of the transparent units 36*a* and 36*b* opposite each other in such a way that no toner remains in those units when the end-of-toner condition is detected. Specifically, the sides of the aforementioned transparent units 36*a* and 36*b* should be arranged so that they are parallel to the direction of gravity, as shown in FIG. 4 above.

Figure 13A:
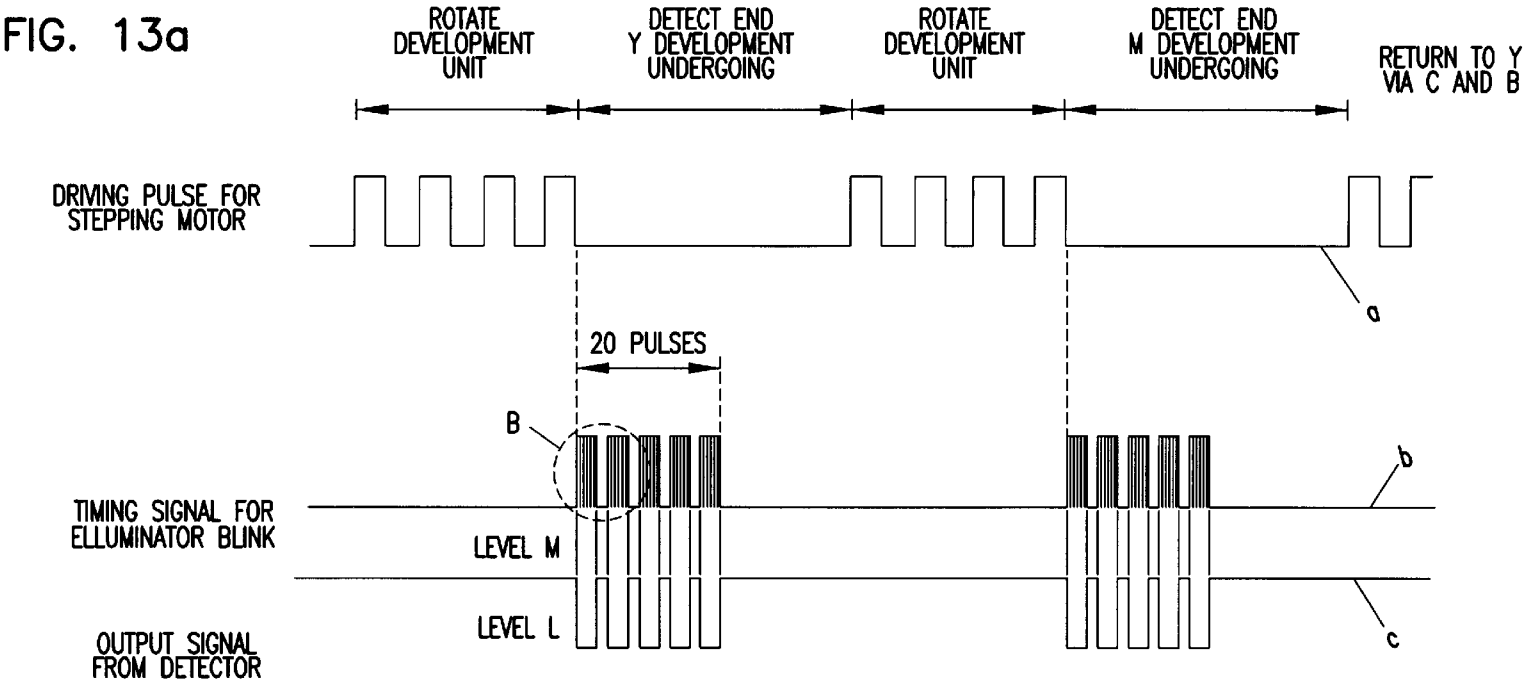
FIG. 13 is a timing chart that shows the rotation timing of the developer unit, the development timing, the flashing timing of the light-emitting unit, and the output timing of output signals from the light sensor.
Figure 13B:
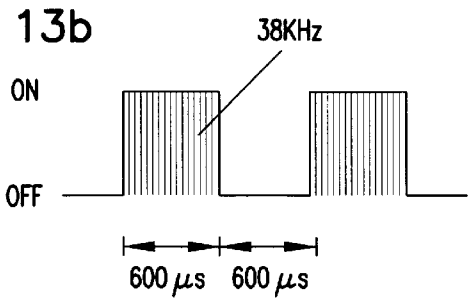

FIG. 13 is a timing chart that shows the rotation timing of the developer unit, the development timing, the flashing timing of the light-emitting unit, and the output timing of output signals from the light sensor among the timing signals that are used for detecting the end-of-toner condition as it relates to the present embodiment mode. The developer unit is rotated by drive pulses that are transmitted to a stepping motor (not shown in the figure). When the rotation of the developer unit stops, the development process commences and a determination is made as to whether an end-of-toner condition has arisen. The light beam from the light-emitting unit 30 turns the pulse light emission at the fundamental frequency of 38 kHz repeatedly at intervals of 600 microseconds, thus producing the so-called burst emission. The on/off operation is repeated 20 times per end-of-toner detection operation. In the example shown in the figure, the output signal from the light sensor 31 remains at the H level when the light is off or when the light beam from the light-emitting unit 30 is not sensed. When a burst on/off light beam is received from light-emitting unit 30, a level L signal is output. The system concludes that the end-of-toner condition has arisen when 20 L/H changes have been detected by the light sensor 31.

Figure 14:
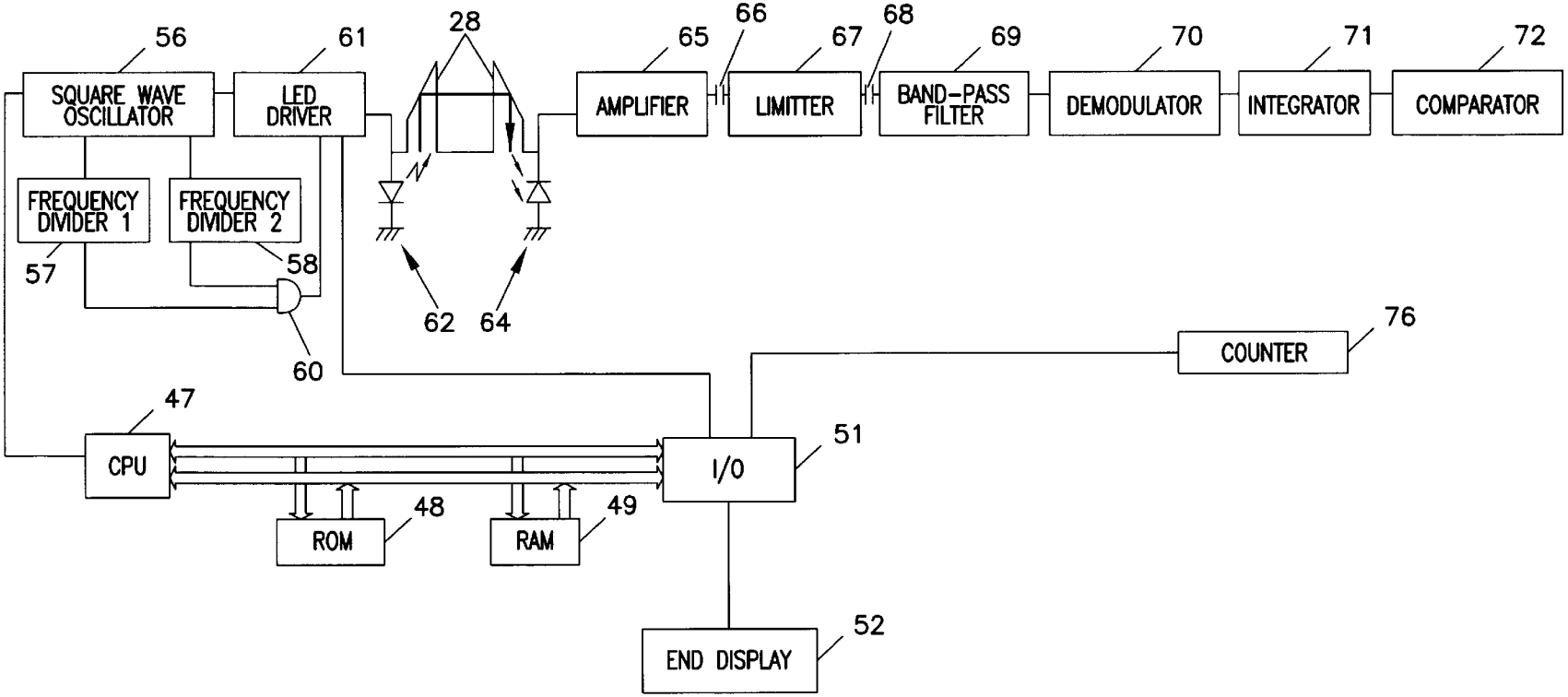
FIG. 14 is a schematic configuration diagram of the signal processing means for detecting the end-of-toner condition.

FIG. 14 shows an example of a signal-processing means that detects the aforementioned end-of-toner condition. CPU47, ROM48, RAM49, and I/O51 are connected by the address bus and the data bus that are indicated by white arrows in the figure. Clock signals with a specified cycle are supplied from a square-wave oscillator 56 to CPU47. The signals generated by the square-wave oscillator 56 are also used as timing signals that turn the light-emitting unit 30 on and off. This signal is used by a divider 1 (57) to generate pulse signals at 38 kHz; it is also used by a divider 2 (58) to generate pulse signals of a 1.2-millisecond cycle. These signals are added by an AND gate 60 and the resulting signal is supplied to an LED driver 61. Then, the I/O control signal indicated by a code 51 turns the LED 62 of the light-emitting unit 30 on and off 20 times on a burst basis. When the inside of the toner hopper 23 has reached the end-of-toner condition, the light beam from the LED 62 enters the transparent unit 36*b* of the recess opposite the light sensor 28*b* from the transparent unit 36*a* of the recess opposite the light-emitting unit 28*a*. Therefore, this light beam is reflected by the reflector 37*b* of the recess opposite the light sensor 28*b* and reaches the photodiode 64 of the light sensor 31. This signal is then amplified by an amp unit 65. Subsequently, capacitors 66 and 68 are used to transmit only the signal components, and a limitter 67 is used to limit the amplitude of the signal. Furthermore, a bandpass filter 69 is used to transmit only the pulse signals of 38 kHz, and then the signals are demodulated using a demodulator 70, and are integrated by an integrator 71. After that, a comparator 72 compares this signal with the aforementioned H-level signal, and the resulting signal is counted by a counter 75. If the value counted by the counter 75 is 20, the CPU47 determines that the end-of-toner condition has occurred, and causes the end-of-toner display unit 52 to display this condition, and prompts the user to replace the toner cartridge of the color that has generated the end-of-toner condition.

Figure 15:
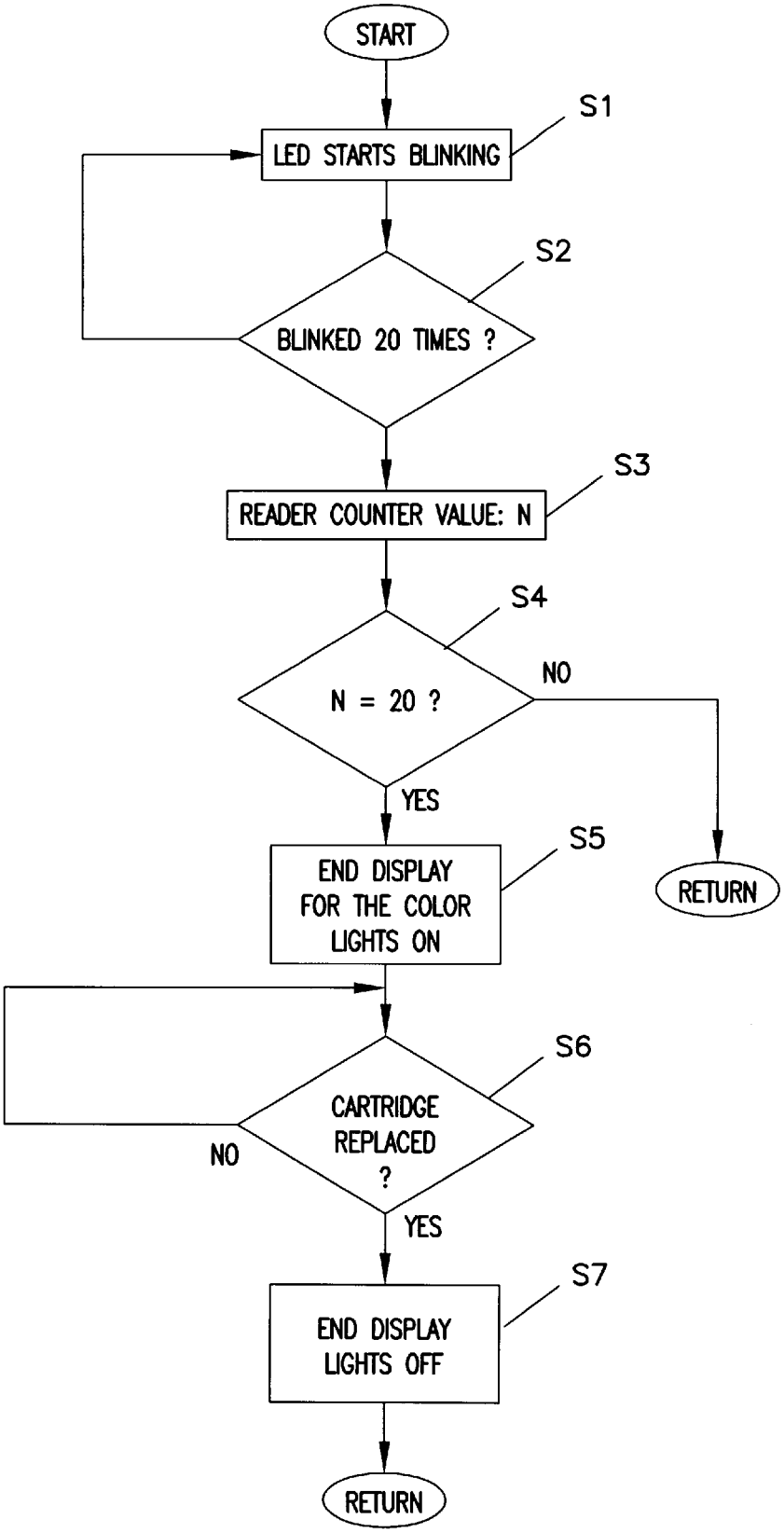
FIG. 15 is a flowchart that depicts the process by which the CPU determines the occurrence of the end-of-toner condition after commencing the process of detecting an end-of-toner condition.

FIG. 15 is a flowchart that shows the process by which the CPU47 of the present embodiment mode determines whether the inside of the aforementioned toner hopper has reached the end-of-toner condition after the CPU has started the process for detecting an end-of-toner condition. When the developer unit stops at the development position and begins the development process, the CPU47 causes the LED62 of the light-emitting unit 30 to turn on and off (Step S1), and determines whether the LED62 has performed 20 burst on and off actions (Step 2). If the number of burst on and off actions has not reached 20, the CPU continues to perform this test. When the number of burst on and off actions has reached 20, the CPU reads count N from counter 75 (Step S3), and determines whether the count is 20 (Step S4). If the count N is 20, the CPU causes the end-of-toner display unit 52 for that color to display that the end-of-toner condition for that color has occurred; otherwise, the CPU returns to the main routine (Step S5). Subsequently, the CPU determines whether the toner cartridge has been replaced based upon the display of the end-of-toner condition (Step S6). In this step, the CPU causes the end-of-toner condition display unit to continue to display the end-of-toner condition until the toner cartridge is replaced. When the toner cartridge has been replaced, the CPU turns off the end-of-toner condition display (Step S7), and returns to the main routine.

Figure 16A:
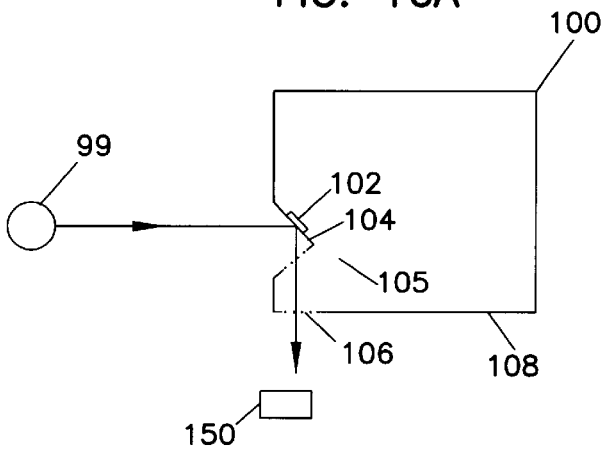
FIGS. 16A and 16B respectively illustrate a cross-sectional view of preferred embodiments according to the current invention which have a reflector either on a concave side wall or a concave bottom wall.

FIG. 16A illustrates one preferred embodiment of a toner cartridge according to the current invention. In order to detect a substantially empty condition of toner in a toner cartridge 100, light is emitted by a light source 99 from a predetermined side towards a reflector 102 which is located on an upper concave wall 104 at a predetermined angle. The angle is such that the emitted light is reflected downwardly towards a bottom wall 108. Along the light path, a portion of a concave wall 105 and a portion 106 of the bottom wall 108 are substantially transparent or light transmitting so that the light reaches a light sensor 150 when the substantially empty condition exists, On the other hand, the toner cartridge is not under the substantially empty condition, opaque toner interferes the emitted light path, and the emitted light fails to reach the light sensor 150.

Figure 16B:
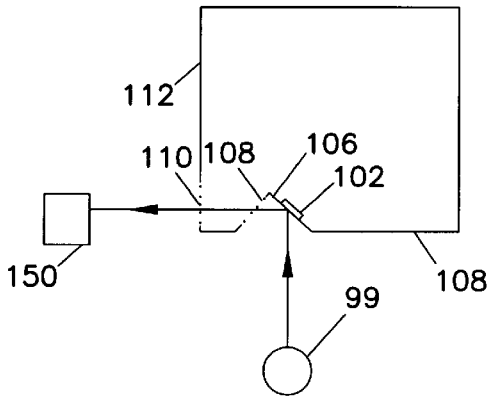

Referring to FIG. 16B, a light source 99 emits light towards a reflector 102 located on a right portion of the concave wall 106 of another preferred embodiment at a predetermined angle according to the current invention. The reflected light travels through a left transparent portion 108 of the concave wall towards an exist portion 110 of the side wall 112 when the toner cartridge 108 is substantially empty. The exited lighted is then detected by a light detection unit 150 to indicate the substantially empty condition.

Figure 17A:
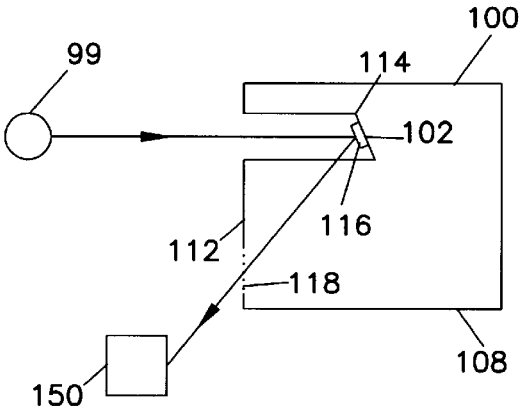
FIGS. 17A and 17B respectively illustrate a cross-sectional view of preferred embodiments according to the current invention which have a reflector on a concave side wall near the top wall and near the bottom wall.
Figure 17B:
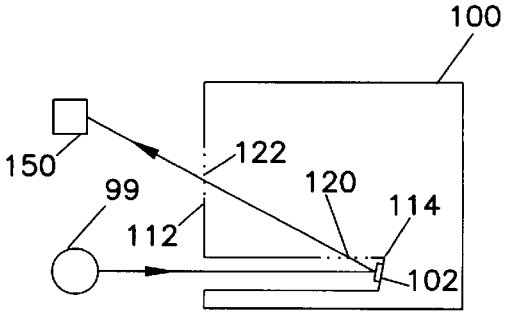

Referring to FIGS. 17A and 17B, alternative embodiments according to the current invention respectively include a relatively deep concave structure or a bore on a side wall 112. At the end of the bore is an angled inside wall 114 where a reflector 102 is affixed at a predetermined angle with respect to the direction of light which is emitted by a light source 99. In a first alternative embodiment as shown in FIG. 17A, the bore is located at a first distance from a bottom wall and the reflector 102 reflects the emitted light towards a transparent portion 116 of an inside wall and then a side wall transparent portion 118 near the bottom wall 108. If the toner cartridge 100 is substantially empty, the above-described emitted light reaches the light detector 150. Otherwise, opaque toner prevents the reflected light from reaching the light detector 150. In a second alternative embodiment as shown in FIG. 17B, the bore is located near the bottom, and the emitted light is reflected upwardly towards a transparent portion 120 and a side wall transparent portion 122. If the toner cartridge 100 is empty, the light is detected by the light detector 150.

Figure 18:
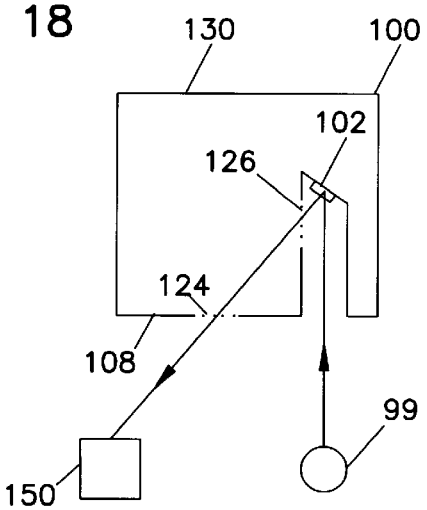
FIG. 18 illustrates a cross-sectional view of a preferred embodiment according to the current invention which has a reflector located at a bottom concave wall.

Referring to FIG. 18, in another alternative embodiment according to the current invention, a light source 99 is located below a toner cartridge 100. The cartridge 100 includes a bore upwardly extending from a bottom wall 108 to a top wall 130. The emitted light into the bore is reflected by a reflector 102 at a predetermined angle towards a transparent portion 124 on the bottom wall through a transparent portion 126 in the bore. If the cartridge is substantially empty, the light detector 150 detects the emitted light.

Figure 19:
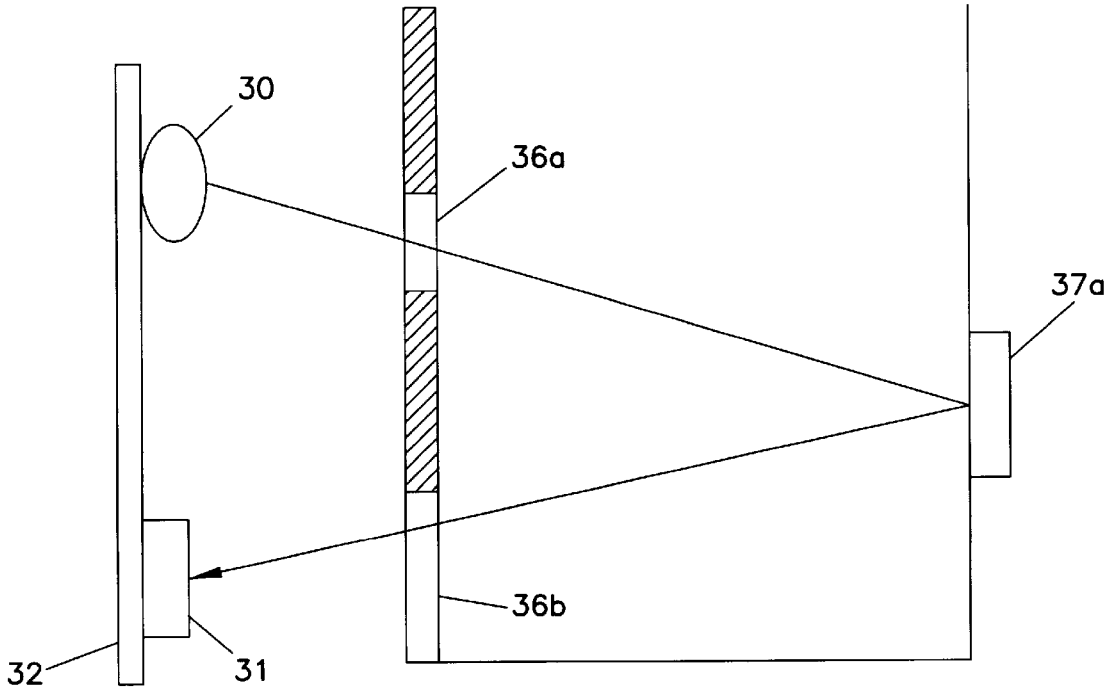
FIG. 19 illustrates another embodiment of the toner cartridge according to the current invention.

FIG. 19 illustrates a cross-sectional view of an alternative embodiment of the toner cartridge for use with an optical detection device according to the current invention. A light source 30 mounted on a holder 32 emits light toward a first light-transmitting portion 36*a* of the toner cartridge, and the light enters the toner cartridge. The entered light reaches a reflector 37*a* located on an opposite wall if the toner cartridge is empty. The light is reflected by the reflector 37*a* and is directed toward a second light-transmitting portion 36*b*. The exited light is then detected by a light sensor 31 for detecting an end toner condition. Although FIG. 19 shows two separate light-transmitting portions 36*a* and 36*b*, different areas of a single light-transmitting portion is used in an alternative embodiment.

Based upon the above embodiment modes, it is possible to provide a developer apparatus to incorporate a low-cost means for detecting an end-of-toner condition that is capable of detecting whether there is some toner remaining in the equipment. Because the presence or absence of residual toner is detected by the light-emitting unit 30 and the light sensor 31 that are provided outside the toner hopper 23, when compared with the equipment in which the light-emitting unit 30 and the light sensor 31 are provided inside the toner hopper 23, the developer apparatus offers the advantage of ease of replacing the toner hopper 23.

We claim:

1. A toner cartridge for use with an optical end detection device, comprising:

a storage area for storing toner which is substantially opaque to prevent light from transmitting;

a light entering groove located on an outer surface of said storage area having a first wall and a second wall, said first wall including at least a light-transmitting portion for allowing said light to enter into said storage area, said second wall including a light guiding portion located on an outer surface of said second wall for guiding said light towards said transmitting portion at a predetermined angle; and a light exiting wall located on said outer surface having a light-transmitting portion for allowing said light to exit from said storage area in a predetermined direction towards the optical end detection device.

2. The toner cartridge according to claim 1 wherein said light guiding portion is a light reflector.

3. The toner cartridge according to claim 2 wherein said light reflector is a light reflecting tape adhered to said second wall.

4. The toner cartridge according to claim 1 wherein said outer surface includes a bottom wall, said light entering groove and said light exiting wall being located on said bottom wall.

5. The toner cartridge according to claim 1 wherein said outer surface includes a side wall, said light entering groove and said light exiting wall being located on said side wall.

6. The toner cartridge according to claim 1 wherein said outer surface includes a bottom wall and a side wall, said light entering groove being located on said side wall while said light exiting wall being located on said bottom wall.

7. The toner cartridge according to claim 1 wherein said outer surface includes a bottom wall and a side wall, said light entering groove being located on said bottom wall while said light exiting wall being located on said side wall.

8. A toner cartridge for use with an optical end detection device, comprising:

a storage area for storing toner which is substantially opaque to prevent light from transmitting;

a light entering groove located on an outer surface of storage area having a first wall and a second wall, said first wall including at least a light-transmitting portion for allowing said light to enter into said storage area, said second wall including a light guiding portion for guiding said light towards said transmitting portion; and a light exiting groove located on said outer surface having a third wall and fourth wall, said third wall including at least a light-transmitting portion for allowing said light to exit from said storage area, said fourth wall including a light guiding portion for guiding said light in a predetermined direction towards the optical end detection device.

9. The toner cartridge according to claim 8 wherein said light guiding portion is a light reflector.

10. The toner cartridge according to claim 9 wherein said light reflector is a light reflecting tape adhered on said second wall and said fourth wall.

11. The toner cartridge according to claim 8 wherein said outer surface includes a bottom wall, said light entering groove and said light exiting groove being located on said bottom wall.

12. The toner cartridge according to claim 8 wherein said outer surface includes a bottom wall and a side wall, said light entering groove and said light exiting groove being located on said side wall near said bottom wall.

13. The toner cartridge according to claim 8 further comprising a light deflecting shield located on said outer surface for preventing said light which does not enter and exit through said light-transmitting portions from reaching the light detection device.

14. The toner cartridge according to claim 8 wherein said outer surface includes a non-reflecting portion for preventing said light which does not enter and exit through said light-transmitting portions from reaching the light detection device.

15. A toner cartridge for use with an optical end detection device, comprising:

a storage area having walls for storing toner which is substantially opaque to prevent light from transmitting;

a least two light transmitting portions located on said walls for allowing the light to enter into and exit from the toner cartridge; and a light reflector located on an outer surface of one of said light transmitting portions for directing the light which entered through said light transmitting portion back towards said light transmitting portion.

* * * * *